US006183103B1

(12) United States Patent
Hillinger

(10) Patent No.: US 6,183,103 B1
(45) Date of Patent: Feb. 6, 2001

(54) DRIVER EXTENSION BAR WITH SELECTIVE ILLUMINATION

(75) Inventor: George Hillinger, Los Angeles, CA (US)

(73) Assignee: Alltrade Inc., Long Beach, CA (US)

( * ) Notice: Under 35 U.S.C. 154(b), the term of this patent shall be extended for 0 days.

(21) Appl. No.: 09/371,155

(22) Filed: Aug. 9, 1999

(51) Int. Cl.[7] ..... B25B 23/18
(52) U.S. Cl. ..... 362/119; 362/120
(58) Field of Search ..... 362/119, 120, 362/184, 109, 208

(56) References Cited

U.S. PATENT DOCUMENTS

| | | | | |
|---|---|---|---|---|
| 5,550,719 | * | 8/1996 | Kuo | 362/120 |
| 5,772,308 | * | 6/1998 | Lin | 362/119 |
| 5,785,408 | * | 7/1998 | Tseng | 362/119 |
| 5,845,986 | * | 12/1998 | Breen | 362/119 |

* cited by examiner

*Primary Examiner*—Thomas M. Sember
(74) *Attorney, Agent, or Firm*—Robert R. Thornton

(57) ABSTRACT

An extension bar for use between a portable driving tool and a driven element includes an elongated body with an integrally formed first end adapted to receive the driving element and an integrally formed second end adapted to engage the driven element, the elongated body having a hollow interior which contains a battery. An illumination control is selectively operable to electrically connect the battery and a light source to illuminate an area surrounding the second end. A transverse passageway extends through the elongated body and has an elongated switch element slidably disposed therein. A pair of insulator rings, disposed one on each end of the switch element, are operable when the switch element is in a first disposition to open the electrical connection between the battery and the light source and are operable when the switch element is in a second disposition to complete the electrical circuit between the battery and the light source. A spring biased detent is centrally disposed in the elongated body and operable to slidably engage said flat face, on which a pair of detent receiving recesses are formed in a longitudinal, spaced apart relationship, to normally hold the switch element in a predetermined one of said first and second dispositions.

6 Claims, 4 Drawing Sheets

DRIVER EXTENSION BAR WITH SELECTIVE ILLUMINATION

BACKGROUND OF THE INVENTION

1. Field of the Invention

The present invention relates to portable tools in general and, in particular, to extension bars used between the driving element of a portable tool and the driven element to extend the reach of the driving element and/or to provide illumination of the area about the driven element.

2. Description of the Prior Art

Extension bars which are used between a driving element of a portable tool and the driven element to extend the reach of the driving element and illuminate the driven element are known in the art, and are illustrated, for example, in U.S. Pat. No. 4,253,134, issued Feb. 24, 1981 to H. T. Barnaby, and in U.S. Pat. No. 5,477,434, issued Dec. 19, 1995 to D. D. Reed. The devices shown in each of these patents utilize a structure in which the light provided by the extension bar passes longitudinally through the bar end which engages the element to be driven, so that the area around the driven element is not illuminated during the driving operation. Also, in each of these devices, the illumination is continuous so long as the extension bar engages the driving element, thereby unnecessarily shortening the life of the battery or batteries used to provide the electrical power source for the illumination.

A device adapted to be temporarily attached around the shank of a screwdriver blade, a drill bit or a drive bar extension so as to be operable to selectively illuminate a work surface, but not extend the reach of the driver element is shown in U.S. Pat. No. 4,480,295, issued Oct. 30, 1984 to F. J. Shuster.

SUMMARY OF THE INVENTION

According to the present invention, an extension bar for use between a portable driving tool and a driven element has an elongated body with an integrally formed first end having a feature adapted to receive the driving element and an integrally formed second end having a feature adapted to engage the driven tool element, the elongated body having a hollow interior which contains at least one battery, at least one light source disposed within the body so as to be external of the hollow interior, and illumination control means selectively operable to electrically connect the battery and the light source to illuminate an area surrounding the second end.

BRIEF DESCRIPTION OF THE DRAWING

Referring now to the accompanying drawing, in which the present invention is shown for purposes of illustration only, and not limitation.

DESCRIPTION OF THE PREFERRED EMBODIMENT

Figure 1:
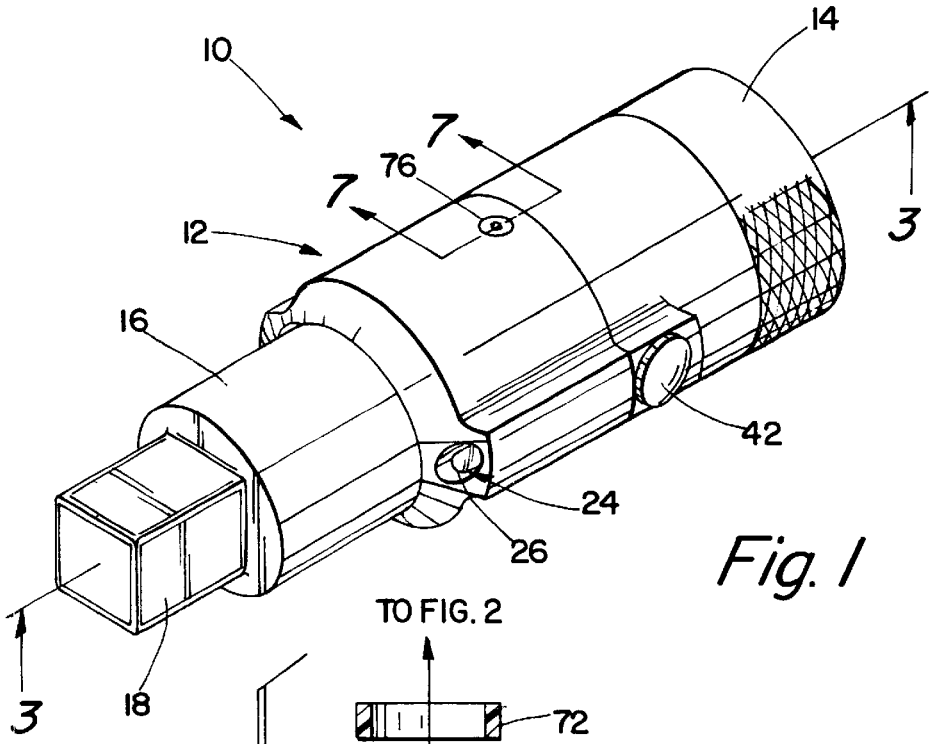
FIG. 1 is a view, in perspective, of an extension bar according to the present inventions.

Referring first to FIGS. 1 through 4, an extension bar 10 has a body 12 comprised by a body driving element end 14 including a feature to receive a tool driving element, and a body driven element end 16, having a feature adapted to engage the element to be driven, for example, a socket by a socket driver 18. However, the use of the socket driver feature 18 is for purposes of illustration only, it being understood that any other type of element commonly used to apply torque to a driven element by a portable tool may be used. Alternatively, a bit receiving recess can be used in place of the socket driver 18.

The driving element engaging end 14 has a central bore 28A extending therethrough and includes a sleeve 22 (see FIG. 2) extending outwardly therefrom into a central bore 20B formed in the driven element engaging end 16. A pair of illumination element receiving apertures 24 are formed in the driven element engaging end 16 external of and longitudinally aligned with the central bore 20B. Illumination means, such as light bulbs 26 are disposed in the apertures 24 so as to be operable, when actuated, to illuminate the area surrounding the socket driver 18. Bulb holders 28 hold the bulbs 26 in the apertures 24. The bulbs 26 each have a pair of lead wires 30. The bulb holders each have an electrical contact sleeve 32 and an electrical contact button 34. The lead wires 30 are connected to the sleeves 32 and buttons 34 in conventional fashion so as to provide electrical circuit continuity from the button 34 through one of the lead wires 30 to an illumination element of the bulb 28 and therefrom through the other lead wire 30 to the bulb holder sleeve 32.

A battery 36 is disposed in the central bore 20B so as to be enclosed by the sleeve 22. A first bias spring 38 is disposed in a bore formed in the driven end engaging element 16 adjacent the socket driver 18 to urge the battery 36 against a switch element 42 (shown in section and elevation in FIGS. 5 and 6), which is disposed in a transverse passageway 44 formed in the driving element engaging end 14 adjacent the sleeve 22. A switch locking disc 46, of any suitable electrically nonconducting material, such as DELRON®, is disposed in the central bore 20A and is urged against the switch element 42 by a bias spring 48 also disposed in the central bore 20A. The switch locking disc 46 has a locking element or detent 50 which engages the switch element 42 to lock the switch element 42 in either the "on" or the "off" positions, as will be explained hereinafter.

Remote from the switch locking disc 46, the central bore 28A terminates in a driving element engaging feature such as a socket drive receiving recess 52, which, for example, is rectangular in cross section for mating with the driving element of a conventional socket wrench (not shown) in the same manner as a conventional extension bar. Obviously, the recess 52 can be of whatever cross sectional configuration is desired in order to mate with the driving element.

Figure 5:
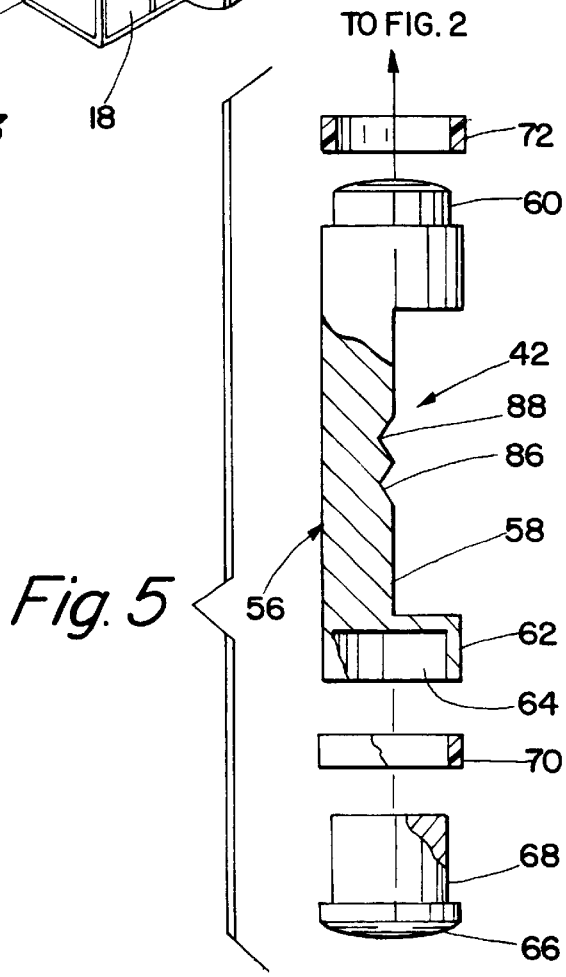
FIG. 5 is an exploded top plan view of the switch element shown in FIG. 3.
Figure 6:
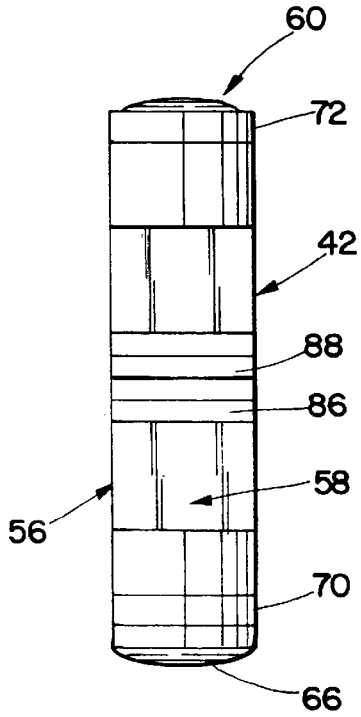
FIG. 6 is a right side elevational view of the switch element shown in FIG. 5.
Figure 2:
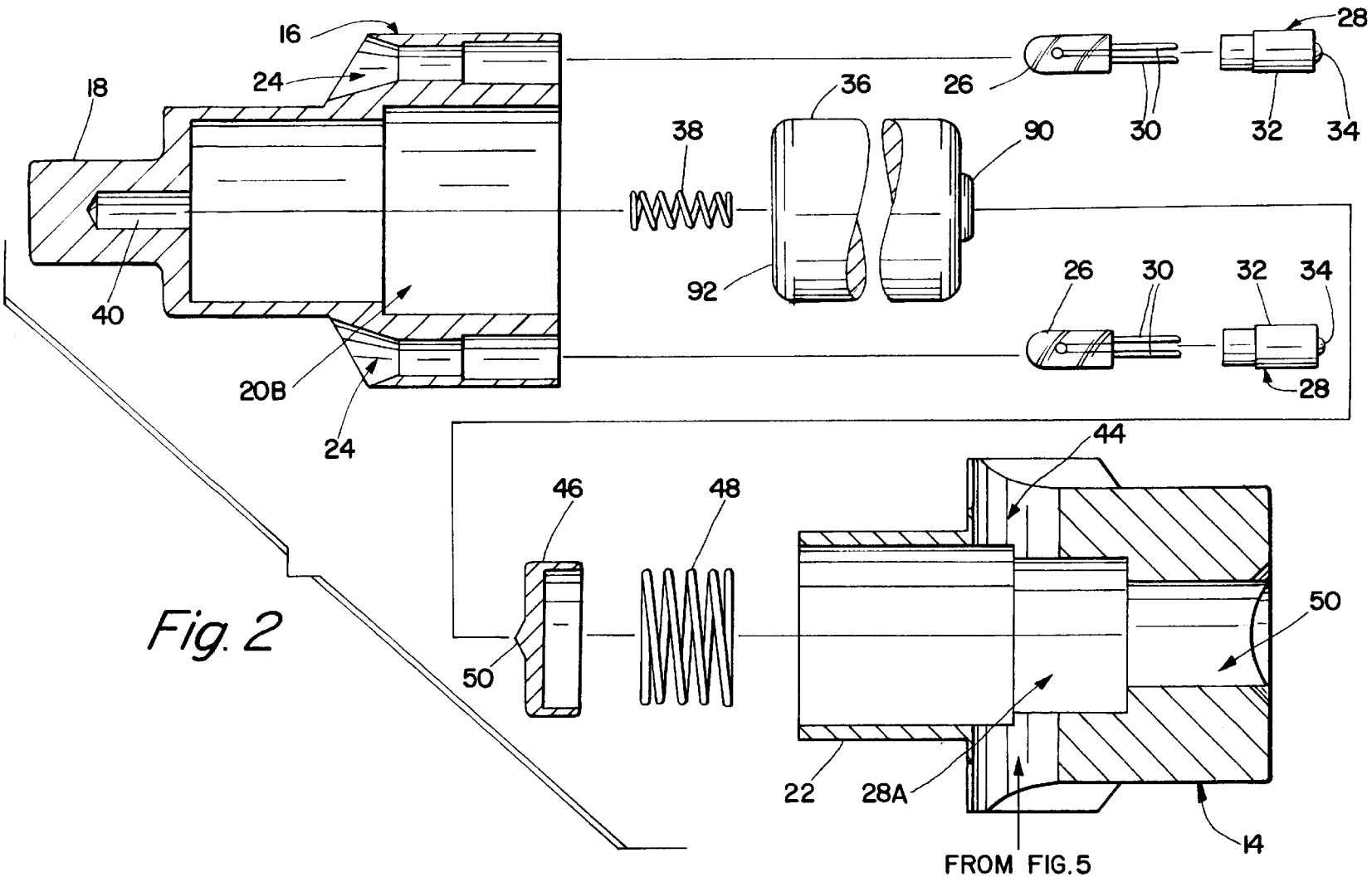
FIG. 2 is an exploded top plan view, partially in section, of the extension bar of FIG. 1, but with the electrical switch element removed for purposes of clarity (see FIG. 5)
Figure 3:
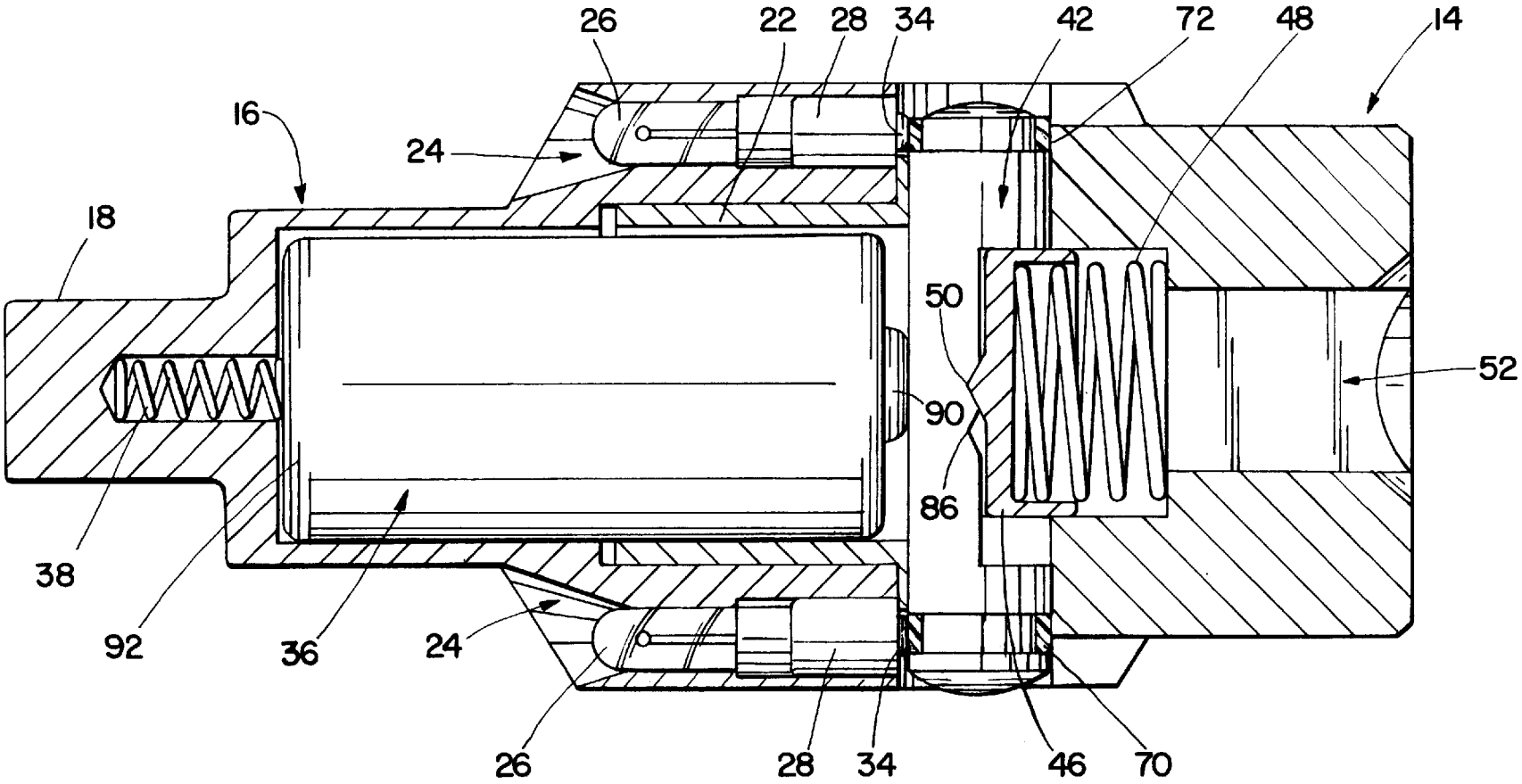
FIG. 3 is a right side elevational view, in section, of the extension bar taken along lines 3—3 of FIG. 1 with the illumination means in its switched off position.
Figure 4:
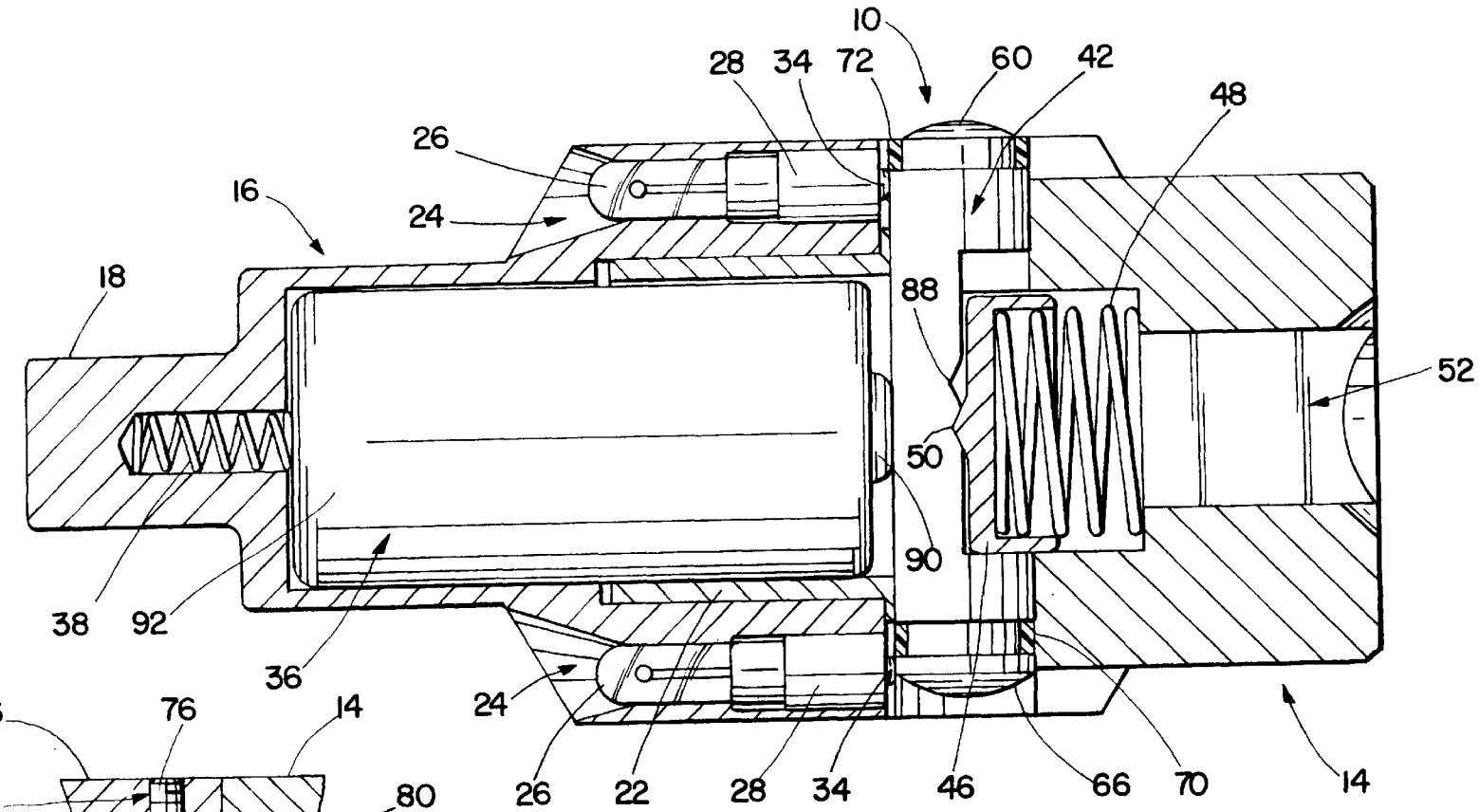
FIG. 4 is a right side elevational view, in section, of the extension bar as shown in FIG. 3 but with the illumination means in its switched on position.

Referring now to FIG. 5, the switch element 42 is shown partially in section. The element 42 includes a cylindrical base 56 which has a central portion 58 which is semi-circular in cross section. A first end 60 of the base 56 is of a reduced circular cross section from the remainder of the base 56. A second end 62 of the base 56 has a circular recess 64 formed axially therein. The switch element has cap 66 with a stem portion 68 of a cross section complementary to the recess 66 but of a longitudinal dimension preferably greater than the depth of the recess 64, so that when the cap 66 is seated in the recess 64, a portion of the stem is exposed. An insulator ring 70, of any suitable electrically insulating material, such as DELRON®, is disposed about the exposed portion of the stem 68 when the stem 68 is disposed in the recess 64. A second insulator ring 72 is disposed by press fitting on the switch element base 56 so as to enclose the first end reduced cross sectional portion 60.

Figure 7:
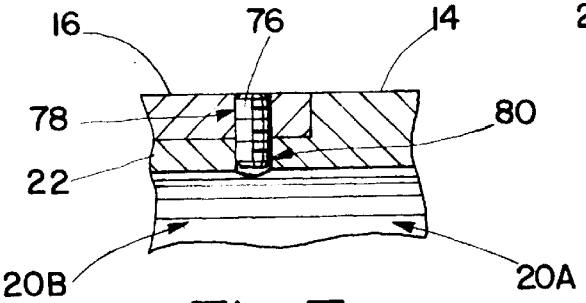
FIG. 7 is a fragmentary sectional view of the extension bar illustrating the structure for attaching together to two halves of the extension body.

FIG. 7 illustrates the presently preferred structure for fastening together the driving element engaging end 14 and the driven element engaging end 16. A threaded fastener 76 (see also FIG. 1) threadably engages the driven element engaging end 16 through a bore 78 extending through one side thereof and a bore 80 extending through the sleeve 22 of the driving element engaging end 14, thereby axially locking the two ends 14,16 together in torque transmitting relationship.

The operation of the switch element 42 to selectively initiate or terminate energization of the light bulbs 26 will now be described. When the switch element 42 is in the position shown in FIG. 3, the light bulb contact buttons 34 are in physical contact with the insulator rings 70, 72, so that there is no completed electrical circuit from the battery 36 through the bulbs 26. The switch element 42 is held in this position by the switch locking element 50, which is urged into engagement with a first slot 86 extending transversely across the base 56 (not shown in FIG. 3, see FIGS. 4 and 5) by the action of the bias spring 48. Manually pressing inwardly on the cap 66 overcomes the bias spring 48 biasing, permitting the switch element to move to the disposition shown in FIG. 4. In the switch position shown in FIG. 4, the contact buttons 34 contact the metallic portions of the switch base 56 and cap 66, so as to complete an electrical circuit from the battery 36 through its positive terminal 90, through the switch element 42, through the bulb holders, 28, lead wires 30, light bulbs 26, driven element engaging end 16 and bias spring 38 to the battery 36 at its outer case 92. In order to switch off the illumination, the switch element is manually returned to its disposition shown in FIG. 3.

Although the presently preferred embodiment of the invention have been set forth herein in detail for illustrative purposes, it will be apparent to those skilled in the art that variations and modifications thereof, including the rearrangement of parts, lie within the scope of the present invention, which is not limited to the specific structures of the embodiments shown or described herein, but only by the scope of the following claims.

The invention claimed is:

1. An extension bar for use with a portable driving tool, said bar having a first end including a driving tool engaging feature and an opposed second end including a driven tool element engaging feature, the extension bar further comprising an elongated body having a hollow, longitudinally extending bore configured to receive a battery;

said body capable of transmitting drive torque between a driving tool and a driven tool element between its opposed first and second ends;

at least one light source disposed in the body laterally outside of said bore, and mounted in the bar so as to project light to an area surrounding said second end of said extension bar.

2. An extension bar according to claim 1, and in which said elongated body has a transverse passageway extending therethrough intermediate the first and second ends; and said switch device includes an elongated switch element slidably disposed in said passageway so as to extend substantially the length thereof, said passageway being of a configuration which is generally complimentary in cross-section to that of the switch element.

3. An extension bar according to claim 2, and in which said switch element is of a generally cylindrical configuration, and including a pair of insulator rings disposed thereon so that one ring is adjacent each end of the switch element, said insulator rings being operable when the switch element is in a first disposition to open the electrical connection between the battery and the light source, and being operable when the switch element is in a second disposition to complete the electrical circuit between the battery and the light source.

4. An extension bar according to claim 3, and in which the switch device includes means for selectively maintaining the switch element either in the first position or in the second position.

5. An extension bar according to claim 4, and in which the switch element position maintaining means includes a flat face portion formed on the switch element intermediate the insulator rings;

spring biased detent means centrally disposed in the elongated body and operable to slidably engage said flat face; and a pair of detent receiving recesses formed in a longitudinal, spaced apart relationship on the switch element flat face, each of which is operable when in engagement with the detent means to normally hold the switch element in a predetermined one of said first and second positions.

6. An extension bar according to claim 1, said first and second ends being constituted of separate body portions each capable of transmitting said drive torque, said body portions being telescopically joined and fastened together against axial separation in torque transmitting relationship.

* * * * *